US005772073A

United States Patent [19]

Deschenes

[11] Patent Number: 5,772,073

[45] Date of Patent: Jun. 30, 1998

[54] APPARATUS FOR DISPENSING INDIVIDUAL PLASTIC FASTENERS FROM FASTENER STOCK

[75] Inventor: Charles L. Deschenes, North Attleboro, Mass.

[73] Assignee: Avery Dennison Corporation, Pasadena, Calif.

[21] Appl. No.: 631,736

[22] Filed: Apr. 10, 1996

[51] Int. Cl.[6] ..... B65H 1/00

[52] U.S. Cl. ..... 221/197; 227/67

[58] Field of Search ..... 221/197; 227/67; 226/67

[56] References Cited

U.S. PATENT DOCUMENTS

| | | | |
|---|---|---|---|
| 4,416,407 | 11/1983 | Bone | 227/67 |
| 4,651,913 | 3/1987 | Bone | 227/67 |
| 5,388,749 | 2/1995 | Davignon et al. | 227/67 |

*Primary Examiner*—Kenneth Noland
*Attorney, Agent, or Firm*—Kriegsman & Kriegsman

[57] ABSTRACT

An apparatus for dispensing plastic fasteners having a cross bar at the end of a filament from fastener stock. The apparatus includes a gun shaped casing made of plastic. A hollow needle having an inlet opening and an outlet opening is mounted on the casing. A guide groove is formed on the casing for receiving the fastener stock, the guide groove being in communication with the inlet opening in the hollow needle and being at an angle with the hollow needle. The apparatus also includes an ejector rod for pushing the cross bar of a fastener fed into the hollow needle out through the outlet opening of the needle. The guide groove in the casing includes a front wall that is bevelled. The front wall includes a bottom edge which is bevelled. The corner formed by the front wall of the groove and a sidewall of the casing is also bevelled. The three bevels minimize the likelihood that the cross bar of the fastener will jam as it passes from the guide groove into the hollow needle.

7 Claims, 5 Drawing Sheets

APPARATUS FOR DISPENSING INDIVIDUAL PLASTIC FASTENERS FROM FASTENER STOCK

BACKGROUND OF THE INVENTION

The present invention relates to an apparatus for dispensing individual plastic fasteners from fastener stock.

Plastic fasteners of the type having a cross bar at one end, a paddle at the other end and a thin filament or cross-link connecting the two ends are well known in the art and widely used in commerce to attach labels, price tags or other items to articles in a manner which minimizes the risk of inadvertent detachment therefrom. Typically, such plastic fasteners are manufactured in the form of fastener stock, the fastener stock being produced by molding or stamping from flexible plastic materials, such as nylon, polyethylene, and polypropylene.

In one known type of fastener stock, the cross bar end of each fastener is connected to a runner bar to form a clip of fasteners. In another known type of fastener stock, often referred to as ladder stock, a pair of elongated side members are interconnected by a plurality of cross links or filaments. One of the side members is shaped to define a plurality of cross bars which are joined together by short severable connectors, the connectors being defined by indentations or notches formed along the side member. The other side member is shaped to define a plurality of paddles.

Additional information pertaining to fastener stock may be found in the following commonly assigned U.S. Patents: U.S. Pat. No. 4,955,475 issued Sep. 11, 1990; U.S. Pat. No. 4,456,161, issued Jun. 26, 1984; U.S. Pat. No. 4,121,487, issued Oct. 24, 1978; U.S. Pat. No. 3,470,834, issued Oct. 7, 1969 and U.S. Pat. No. 3,103,666, issued Sep. 17, 1963.

The dispensing of individual fasteners from fastener stock is often accomplished with an apparatus commonly referred to as a "tagger gun". Typically, a tagger gun is a hand held trigger operated device which is constructed to accept fastener stock. Tagger guns usually include a mechanism for feeding the cross bar end of a fastener into a hollow needle at the front end of the gun and a mechanism for pushing the cross bar end of the fastener that has been fed into the hollow needle out through the tip of the hollow needle. Some tagger guns are manually operated while other tagger guns are powered by an electric motor.

Tagger guns have been developed and are in use with both of the above described types of fastener stock.

In commonly assigned U.S. Pat. No. 4,651,913 which issued Mar. 24, 1987 and which is herein incorporated by reference, a tagger gun for dispensing a plastic fastener through a hollow needle from a clip of fastener stock is described. The apparatus includes a frame, a trigger, a plunger, a hollow slotted needle and a linking assembly. The frame includes a fastener clip guide groove which is at an angle with the hollow needle. In use, a fastener clip is fed into the guide groove and then routed down into alignment with the hollow needle.

In commonly assigned U.S. Pat. No. 5,074,452 which issued Dec. 24, 1991 and which is also incorporated herein by reference there is disclosed a tagger gun for dispensing plastic fasteners from a clip of fastener stock. The tagger gun includes a frame having a fastener clip guide groove and in which an ejector rod is advanced by a trigger operated lever to sever an individual fastener from a fastener clip and dispense the severed fastener through a hollow slotted needle which is at an angle to the guide groove. The apparatus incorporates a unitary, single-tooth feed member for advancing the fastener assemblage to bring the forward-most fastener in line with the needle. The feed member comprises a reciprocally mounted body integral with a U-shaped resilient finger terminating in a feed tooth. The feed member together with its resilient feed finger moves linearly in order to engage and advance the fastener assemblage, while the finger flexes during a return motion in order to clear a succeeding fastener in the assemblage.

In U.S. Pat. No. 5,388,748 which issued on Feb. 14, 1995 and which is also incorporated herein by reference, there is disclosed an electric powered apparatus for dispensing plastic fasteners from a clip of fastener stock. The apparatus includes a gun shaped casing. A hollow slotted needle having an inlet opening is mounted on the casing. A fastener clip guide groove is formed on the casing at an angle to the hollow slotted needle for receiving the fastener stock, the guide grove being in communication with said inlet opening in said hollow needle. A feeder element for intermittently advancing fastener stock loaded into the guide groove is mounted on the casing. An ejector rod is provided for pushing plastic fasteners from the fastener stock through and out of the hollow needle, one at a time. The ejector rod and feeder element are driven by an electric motor powered by a battery pack removably mounted in the casing and which contains rechargeable batteries. The battery pack includes a receptacle which is arranged to enable the batteries to be recharged with the battery pack in or out of the tool. A convertor assembly is provided for converting rotary motion of the drive shaft of the motor into linear motion of the ejector rod, the convertor assembly including a worm on the drive shaft, a worm gear driven by the worm, a spur gear loosely coupled to the worm gear, a slider for holding the ejector rod and a rack driven by the spur gear and mounted on the slider. First and second single pole double throw switches are provided for controlling the operation of said electric motor so as to either cause rotation of the drive shaft in one direction, cause rotation of the drive shaft in the other direction or stop rotation of the drive shaft. The first switch is operated by a trigger which is pivotally mounted on the casing and the second switch is operated by an actuator moved by a slide bar which is moved by the slider.

It has been found that tagger guns of the type such as described above may, on occasion, become jammed in the area where the fastener to be dispensed passes from the guide groove into the hollow slotted needle.

SUMMARY OF THE INVENTION

It is an object of the present invention to provide a new and improved apparatus for dispensing plastic fasteners from fastener stock.

It is another object of the present invention to provide a new and improved apparatus for dispensing plastic fasteners from fastener stock wherein the fastener stock is fed into the apparatus through a guide groove and routed into alignment with a slotted needle which is at an angle with the guide groove.

It is yet another object of the present invention to provide an apparatus as described above in which the likelihood of the individual plastic fasteners becoming jammed as they are dispensed is decreased.

Accordingly, there is provided an apparatus for dispensing plastic fasteners from a fastener stock, each plastic fastener having a cross bar at the end of a filament, said apparatus comprising a casing, a hollow needle mounted on said casing, said hollow needle having an inlet opening and an outlet opening, a guide groove in said casing for receiving the fastener stock, said guide groove being in communication with said inlet opening in said hollow needle and being at an angle with said hollow needle, and an ejector rod for pushing the cross bar of a fastener aligned with said hollow needle into said hollow needle and out through the outlet opening of the needle, wherein said casing is shaped to reduce the likelihood of jamming as a fastener passes from the guide groove into said hollow needle upon actuation of said ejector rod.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
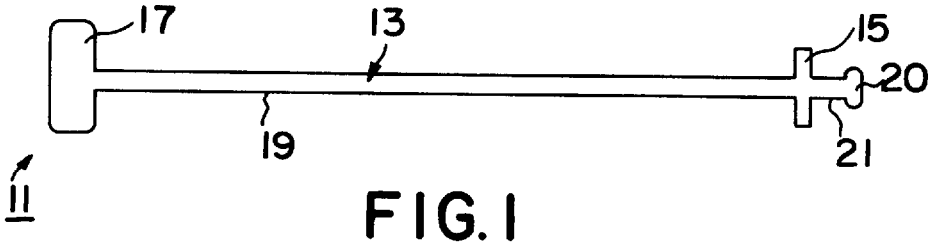
FIG. 1 is a side view of a clip of fastener stock which may be used with the apparatus of this invention.
Figure 2:
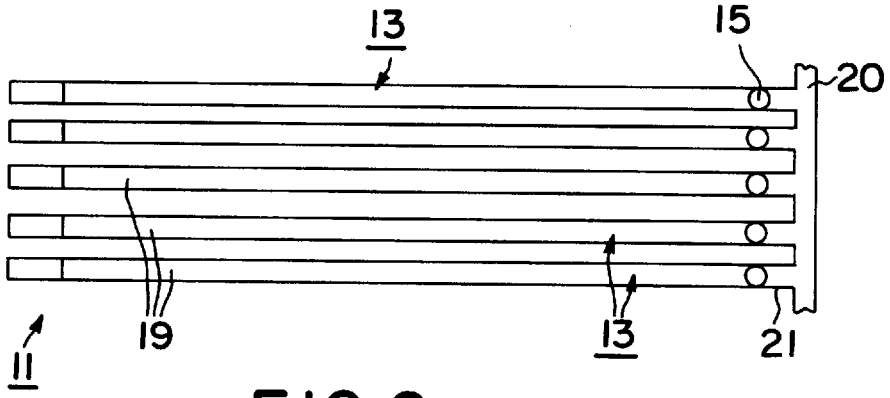
FIG. 2 is a front view of the clip of fastener stock of FIG. 1.
Figure 3:
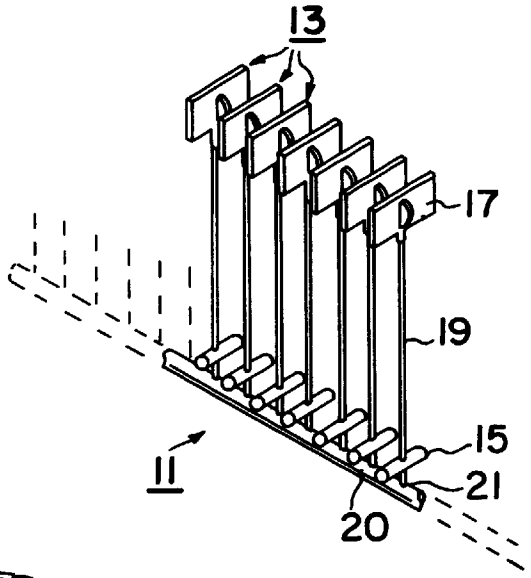
FIG. 3 is a perspective view of the clip of fastener stock of FIG. 1.

Referring to the drawings, there are shown in FIGS. 1–3, side, front and perspective views, respectively, of a clip of fastener stock, the clip of fastener stock being identified by reference numeral 11. As can be seen, clip 11 includes a plurality of individual fasteners 13. Each fastener 13 comprises a first end which is shaped to define a cross bar 15, a second end which is shaped to define a paddle 17, and a thin filament 19 which interconnects cross-bar 15 and paddle 17. Each fastener 13 is coupled to a common runner bar 20 by a short connector filament 21 at the cross bar 15 of fastener 13. Clip 11 is made of a plastic material such as nylon, polyethylene or polypropylene.

Figure 5:
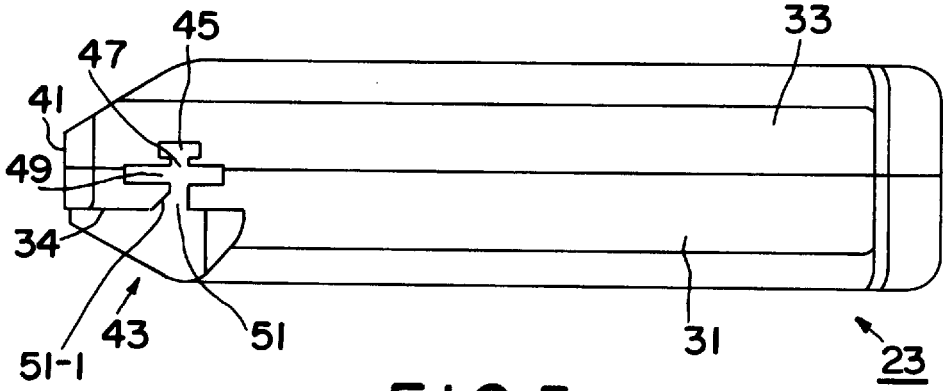
FIG. 5 is a top view of the apparatus shown in FIG. 4.
Figure 4:
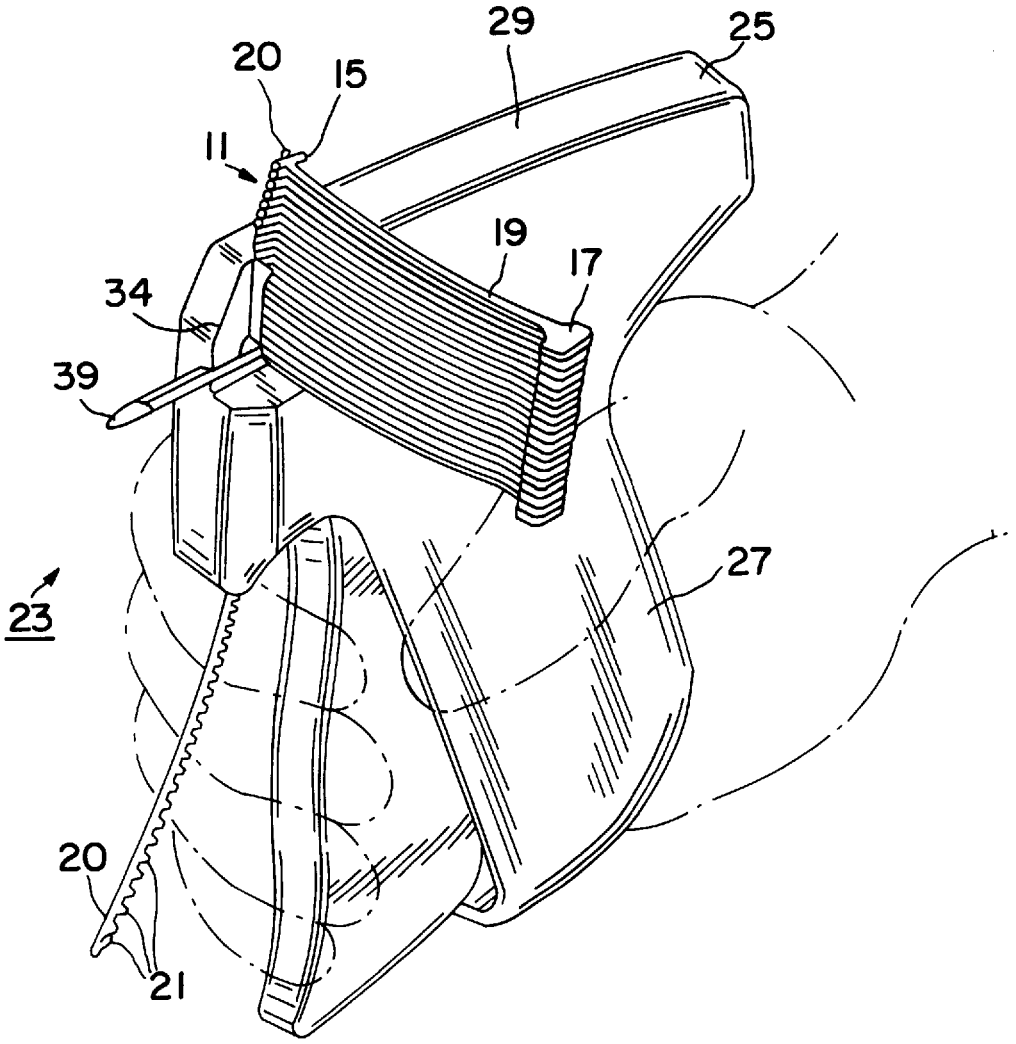
FIG. 4 is a perspective view of an apparatus constructed according to this invention, with a fastener clip installed.
Figure 6:
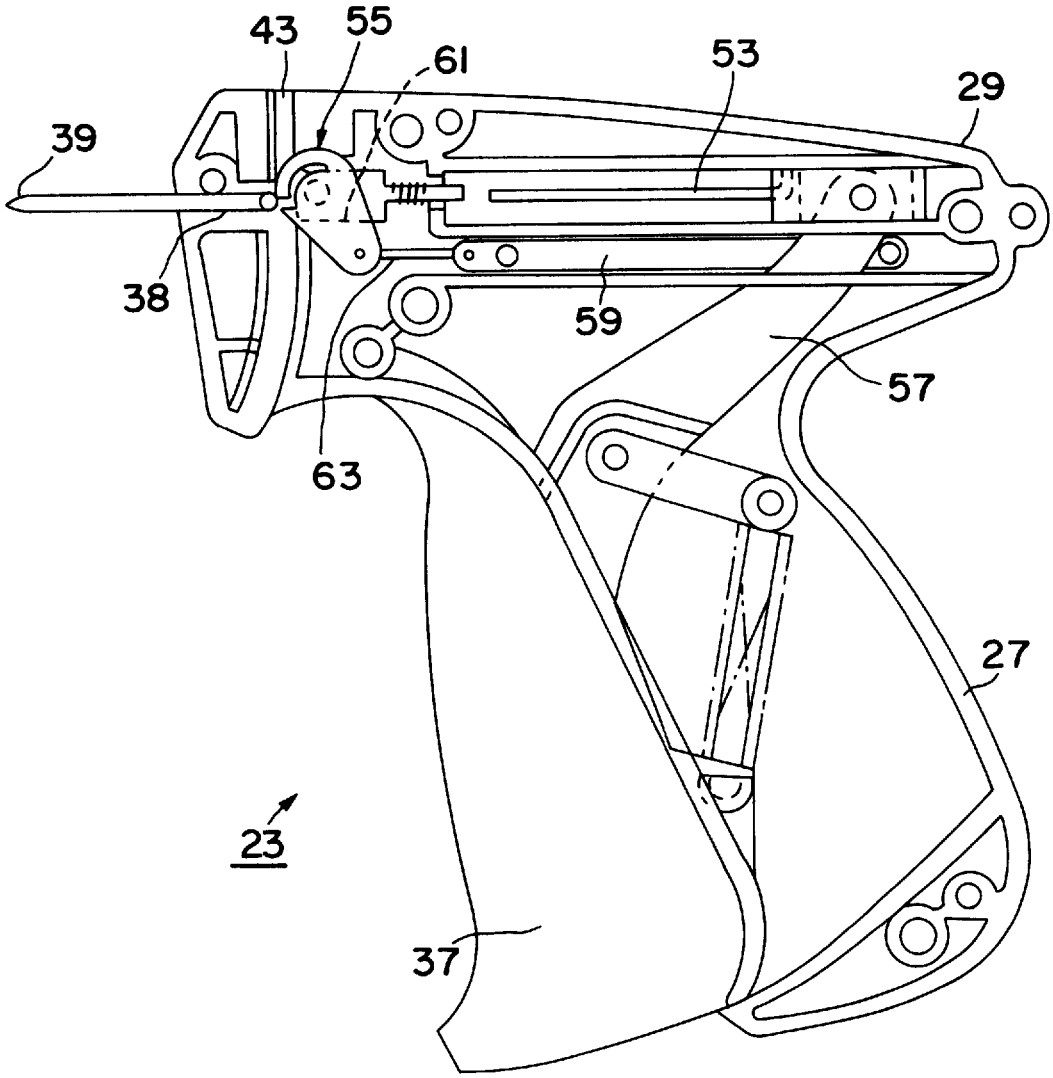
FIG. 6 is a view showing the internal construction of the apparatus in FIG. 4.

Referring now to FIGS. 4 and 5, there are shown perspective and top views, respectively, of an apparatus constructed according to this invention for dispensing plastic fasteners 13 from clip 11, the apparatus being identified by reference numeral 23. In FIG. 4, apparatus 23 is shown with clip 11 installed. A view of the internal construction of apparatus 23 is shown in FIG. 6.

Apparatus 23 includes a hollow gun-shaped casing 25 having a handle portion 27 and a barrel portion 29. Casing 25 is formed of a right half 31 and a left half 33. Left half 33 includes a sidewall 34. Halves 31 and 33 may be fabricated from any convenient material, such as molded plastic and are joined together by screws 35. Alternatively, halves 31 and 33 may be joined together by a snap-fit, by sonic welding, by gluing, by riveting or the like. Apparatus 23 is hand actuated by a lever type trigger 37 located at the front of handle portion 27.

A hollow needle 39 is removably mounted in a forwardly extending needle retaining groove 38 in barrel portion 29 and extends out through an opening 40 at the front end 41 of barrel portion 29. Needle 39 includes an inlet opening 42-1 for receiving the cross bar 15 of each individual fastener 13 and an outlet opening 42-2 in the shape of a pointed tip through which each individual fastener 13 exits.

A downwardly extending guide groove 43 is formed in the top of barrel portion 29 into which fastener stock 11 is inserted. As shown in FIG. 5 guide groove 43 includes a common runner bar groove portion 45 through which common runner bar 20 is fed into, a short connector filament groove portion 47 through which connector filament 21 is fed into, a cross bar groove portion 49 through which cross bar 15 is fed into, and a thin filament groove portion 51 through which a portion of thin filament 19 is fed into. Thin filament groove portion 51 includes a front wall 51-1 and a bottom edge 51-2. As can be seen, guide groove 43 is at an angle with needle retaining groove 38 and in communication with inlet opening 42-1 of needle 39.

Apparatus 23 further includes an ejector rod 53 for pushing the cross bar of a fastener 13 to be dispensed out through needle 39, a feed member 55 for moving fasteners 13 to be dispensed down guide groove 43 into alignment with needle 39, one at a time, a linkage 57 coupling ejector rod 53 to trigger 37 and an actuator bar 59 for controlling movement of feed member 55. Apparatus also includes an antilock 61 and a coupling rod 63.

Figure 8:
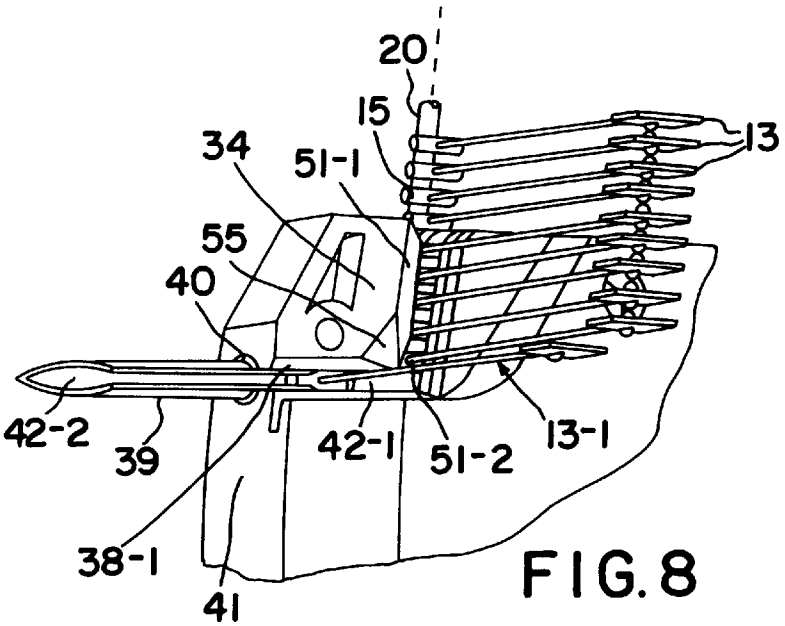
FIG. 8 is an enlarged perspective view of the portion of the apparatus shown in FIG. 7, with a clip of fastener stock inserted therein.
Figure 7:
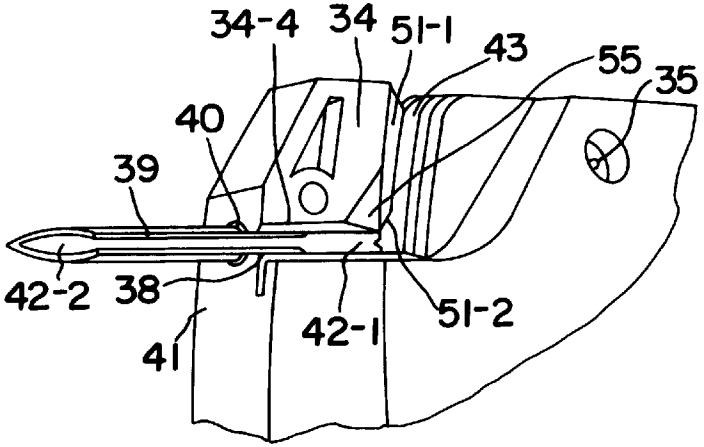
FIG. 7 is an enlarged perspective view of the front end of the barrel of the apparatus in FIG. 4.

In order to reduce the likelihood of jamming caused by filament 19 of a fastener 13 catching on the front wall 51-1 of thin filament groove portion 15 as fastener 13 moves from guide groove 43 into needle 39, front wall 51-1 is not at right angles with side wall 34 but, rather is bevelled as shown in FIGS. 5, 7 and 8. In addition, as shown in FIGS. 7 and 8, bottom edge 51-2 of wall 51-1 is bevelled. Also, the corner 55 formed by bevelled wall 51-1, sidewall 34 and top wall 38-1 is bevelled as shown in FIGS. 6 through 8. Bevelled wall 51-1, bevelled edge 51-2 and bevelled corner 55 all reduce the likelihood of faster 13 jamming within groove 43 as it makes the turn in moving from guide groove 43 into needle 39.

Apparatus 23 functions in the same way as gun 10 in U.S. Pat. No. 4,651,913 and may be used to attach individual fasteners 13 and merchandise tags to articles of commerce, such as articles of clothing, in the same manner as in U.S. Pat. No. 4,651,913. Also, except for the three bevels, apparatus 23 is structurally the same as apparatus 10. More specifically, clip 11 is inserted into groove 43 of apparatus 23 so that the cross bar 15 of the bottom fastener 13-1 in stock 11 is positioned within inlet opening 42-1 of needle 39. With the pointed tip of outlet opening 42-2 inserted through the desired merchandise tag and article of commerce, trigger 37 is actuated. Actuation of trigger 37 causes cross bar 15 of bottom fastener 13-1 to be ejected out through outlet opening 42-2 of needle 39. Needle 39 includes a knife edge 61 which serves to separate a fastener 13 from the fastener stock 11 as it is fed through hollow needle 39.

As stated above, bevelled wall 51-1, bevelled edge 51-2 and bevelled corner 55 prevent fasteners 13 from becoming jammed within apparatus 23 as they pass from guide groove 43 into needle 39.

Figure 9:
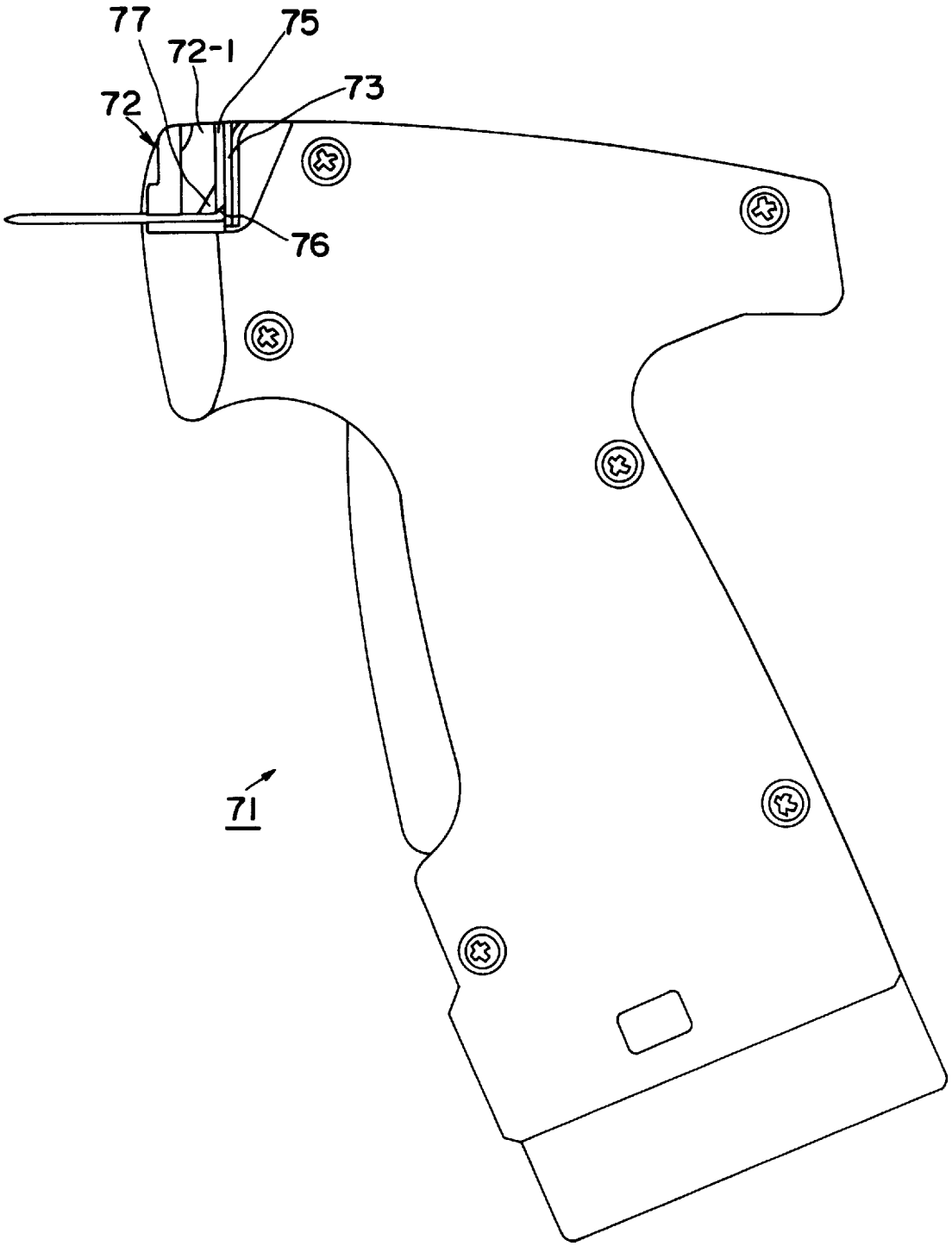
FIG. 9 is a side view of another apparatus constructed according to this invention.

In FIG. 9 is shown a side view of another apparatus 71 for dispensing plastic fasteners constructed according to this invention. Apparatus 71 includes a casing 72, casing 72 including a left half 72-1 having a guide groove 73, a bevelled front wall 75, a bevelled bottom edge 76 and also a bevelled corner 77. Except for the bevels, apparatus 71 is the same as apparatus 23 in U.S. Pat. No. 5,388,748.

The embodiments of the present invention described above are intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. An apparatus for dispensing plastic fasteners from fastener stock, each plastic fastener having a cross bar at the end of a filament, said apparatus comprising:

a. a casing, b. a hollow needle mounted on said casing, said hollow needle having an inlet opening and an outlet opening, c. a guide groove in said casing for receiving the fastener stock and routing the fasteners into alignment with said hollow needle one at a time, said guide groove being in communication with said inlet opening in said hollow needle, and being at an angle with said hollow slotted needle, said guide groove including a front wall, and d. an ejector rod for pushing the cross bar of a fastener fed into said hollow needle out through the outlet opening of the needle, e. said front wall in said guide groove in said casing being bevelled to reduce the likelihood of jamming when the cross bar of a fastener passes into said hollow needle from said guide groove.

2. The apparatus as claimed in claim 1 wherein the corner where said guide groove communicates with said hollow needle is bevelled.

3. The apparatus as claimed in claim 2 wherein said front wall includes a bottom edge which is bevelled.

4. The apparatus as claimed in claim 3 further comprising a feeder element for intermittently advancing said fastener stock loaded into said guide groove so that the cross bar of a fastener to be dispensed is fed into said hollow needle.

5. The apparatus as claimed in claim 4 further comprising a trigger and a linkage for coupling said ejector rod to said trigger.

6. The apparatus of claim 4 wherein said ejector rod is manually driven.

7. The apparatus of claim 4 wherein said ejector rod is driven by a motor.

* * * * *